US011852999B2

(12) United States Patent
Iizuka et al.

(10) Patent No.: US 11,852,999 B2
(45) Date of Patent: Dec. 26, 2023

(54) IMAGE FORMING DEVICE WITH FRAME HAVING METAL PLATES WITH IMPROVED RESILIENCY

(71) Applicant: CANON KABUSHIKI KAISHA, Tokyo (JP)

(72) Inventors: Yoichiro Iizuka, Tokyo (JP); Kohei Koguchi, Kanagawa (JP); Masatoshi Yamashita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/959,574

(22) Filed: Oct. 4, 2022

(65) Prior Publication Data

US 2023/0023209 A1 Jan. 26, 2023

Related U.S. Application Data

(62) Division of application No. 17/293,901, filed as application No. PCT/JP2019/047977 on Dec. 3, 2019, now Pat. No. 11,493,875.

(30) Foreign Application Priority Data

Dec. 4, 2018 (JP) ..... 2018-227620

(51) Int. Cl.
*G03G 21/16* (2006.01)
*B41J 29/02* (2006.01)

(52) U.S. Cl.
CPC ..... *G03G 21/1619* (2013.01); *B41J 29/02* (2013.01)

(58) Field of Classification Search
CPC ..... G03G 21/1619; B41J 29/02
See application file for complete search history.

(56) References Cited

U.S. PATENT DOCUMENTS

| | | | | |
|---|---|---|---|---|
| 6,983,113 | B2 | 1/2006 | Yamamoto et al. | 399/109 |
| 7,082,660 | B2 | 8/2006 | Kato et al. | 29/401.1 |
| 8,897,669 | B2 | 11/2014 | Matsuno | 399/107 |
| 9,037,036 | B2 | 5/2015 | Yamashita et al. | 399/110 |

(Continued)

FOREIGN PATENT DOCUMENTS

| | | |
|---|---|---|
| JP | 2001-242669 | 9/2001 |
| JP | 2003-071420 | 3/2003 |

(Continued)

OTHER PUBLICATIONS

Office Action dated Nov. 10, 2022 in counterpart GB Application No. GB2215970.1.

(Continued)

*Primary Examiner* — Sandra Brase
(74) *Attorney, Agent, or Firm* — Venable LLP

(57) ABSTRACT

An image forming apparatus includes a first metal plate provided with a through hole; a second metal plate provided opposed to the first plate; a third metal plate provided between the first plate and the second plate; and a fixing member fixing the first plate and the third metal plate to each other. The fixing member has a first surface and a second surface extending in a direction crossing the first surface. The third metal plate extends outward in a direction in which the first plate and the second plate opposes to each other, and the third metal plate is provided with a first projection penetrating the through hole, and wherein the first projection is fixed on the first surface. The first plate is fixed on the second surface of the fixing member.

13 Claims, 18 Drawing Sheets

(56) References Cited

U.S. PATENT DOCUMENTS

| | | | | |
|---|---|---|---|---|
| 9,411,301 | B2 | 8/2016 | Suzuki et al. | G03G 21/1619 |
| 9,599,951 | B2 | 3/2017 | Yamaguchi et al. | G03G 21/1695 |
| 9,785,107 | B2 | 10/2017 | Nagasaki | G03G 21/1619 |
| 9,857,761 | B2 | 1/2018 | Osawa et al. | G03G 21/1661 |
| 10,459,382 | B2 | 10/2019 | Iizuka | G03G 21/1671 |
| 11,048,204 | B2 | 6/2021 | Sawashima et al. | G03G 21/1661 |
| 2003/0044198 | A1 | 3/2003 | Kato et al. | 399/109 |
| 2003/0059229 | A1 | 3/2003 | Yamamoto et al. | 399/109 |
| 2004/0183884 | A1 | 9/2004 | Haginoya et al. | G02B 26/10 |
| 2005/0069340 | A1 | 3/2005 | Noda et al. | G03G 15/00 |
| 2013/0129380 | A1 | 5/2013 | Matsuno | 399/107 |
| 2015/0220047 | A1 | 8/2015 | Suzuki et al. | 399/107 |
| 2015/0248104 | A1 | 9/2015 | Kozushi | G03G 21/1619 |

FOREIGN PATENT DOCUMENTS

| | | |
|---|---|---|
| JP | 2003-237176 | 8/2003 |
| JP | 2013-109141 | 6/2013 |
| JP | 2015-163959 | 9/2015 |

OTHER PUBLICATIONS

International Search Report and Written Opinion in counterpart PCT/JP2019/047977.

Office Action dated Sep. 26, 2023 in counterpart Germany Application No. 11 2019 006 026.0, together with English translation thereof.

(a)

(b)

(c)

(a)

(b)

IMAGE FORMING DEVICE WITH FRAME HAVING METAL PLATES WITH IMPROVED RESILIENCY

This application is a divisional of application Ser. No. 17/293,901 filed May 13, 2021, currently pending, which was a national stage application filed under 35 U.S.C. § 371 of International Application No. PCT/JP2019/047977 filed Dec. 3, 2019; and claims priority under 35 U.S.C. § 119 from Japanese Patent Application No. 2018-227620 filed in Japan on Dec. 4, 2018; and the contents of all of which are incorporated herein by reference as if set forth in full.

TECHNICAL FIELD

The present invention relates to an image forming apparatus such as an electrophotographic copying machine, an electrophotographic printer (laser beam printer and LED printer, for example).

BACKGROUND ART

In the field of image forming apparatus, frames made up of pieces of metallic plate are widely in use. For example, referring to FIG. 16, bent portions 161*a*, 171*a* and 181*a* are formed by bending a fixation stay 161 for supporting a fixing apparatus, an optics stay 171 for supporting a laser scanner unit, and a main stay 181 for supporting a sheet conveyance system, respectively, along their edges. The bent portions 161*a*, 171*a*, and 181*a* are welded to the right and left plates 151 and 141, at points W to yield a frame 126 (Japanese Laid-open Patent Application No. 2015-163959).

Further, referring to FIG. 17, a frame made up of a metallic stay 202 (formed of metallic plate), a left plate 200, and a right plates 201 has been known as a frame for an image forming apparatus. In this case, the metallic stay 202 is connected to the left and right plates 200 and 201 (Japanese Laid-open Patent Application No. 2013-109141). Also in this case, the metallic stay 202 is provided with a main portion 202*a* which horizontally extends, and a pair of connective portions 202*b* which are perpendicular to the lengthwise ends of the main portion 202*a*, one for one. More specifically, the connective portion 202*b* is put through a through hole 200*a*, with which the left plate 200 is provided. Then, it is held to the left plate 200 with small screw 203.

There has been known another frame for an image forming apparatus. It is made up of a combination of pieces of metallic plate. Referring to FIG. 18, in the case of this frame, it is formed of a left plate 300, a right plate 301, flanges 302, supporting portions 303, metallic stays 304. The flanges 302 are formed by perpendicularly bending the top, left and right edge portions of the plates 300 and 301, one for one, to the main portion of the left and right plates 300 and 301 (Japanese Laid-open Patent Application No. 2001-242669).

A frame made up of a combination of two or more pieces of metallic plate are superior to a molded one-piece frame, in that the former is more precisely formable in dimension, and also, that the pieces of metallic plate, of which the former is made, are flat, and therefore, are easier to ship than the latter.

Metallic plate is unlikely to be deformed by an external force, as long as the external force is perpendicular to the thickness direction of the plate. However, if the external force, to which metallic plate is subjected, is parallel to the thickness direction of the plate, metallic plate is less resistant to the external force, and therefore, is likely to be deformed by the external force. Therefore, in a case where the frame of an image forming apparatus is structured so that the bent portion 161*a* of the fixation stay 161, bent portion 171*a* of the optics stay 171, and bent portion 181*a* of the main stay 181 are welded to the right and left plates 151 and 141, if the right plate 151 and/or left plate 141 is subjected to external force, the bent portions 161*a*, 171*a*, and 181*a* are subjected to such a force that is parallel to their thickness direction. Therefore, they are likely to change in their angle relative to the main portion of fixation stay 161, optics 171, and main stay 181, respectively.

As the bent portions 161*a*, 171*a* and 181*a* change in their angle relative to the main portions of the fixation stay 161, optics stay 171, and main stay 181, respectively, the members of the image forming apparatus, which are supported by the frame, change in their positional relationship to each other. For example, the laser scanner unit and photosensitive drum change in their positional relationship. Consequently, the image forming apparatus is negatively affected in image quality. That is, the image forming apparatus outputs such images that are deformed and/or suffer from color deviation.

The present invention was made in consideration of the problem described above. Thus, the object of the present invention is to provide an image forming apparatus, which is substantially smaller in the amount of deformation of its frame made up of a combination of two or more pieces of metallic plate, than any conventional image forming apparatus.

SUMMARY OF THE INVENTION

According to an aspect of the present invention, there is provided an image forming apparatus comprising a first metal plate provided with a through hole; a second metal plate provided opposed to said first metal plate; a third metal plate provided between said first metal plate and said second metal plate; and a fixing member fixing said first metal plate and said third metal plate to each other, wherein said fixing member has a first surface and a second surface extending in a direction crossing said first surface, wherein said third metal plate extends outward in a direction in which said first metal plate and said second metal plate opposes to each other, and said third metal plate is provided with a first projection penetrating said through hole, and wherein said first projection is fixed on said first surface, and wherein said first metal plate is fixed on said second surface of said fixing member.

Further features of the present invention will become apparent from the following description of exemplary embodiments with reference to the attached drawings.

Figure 17:
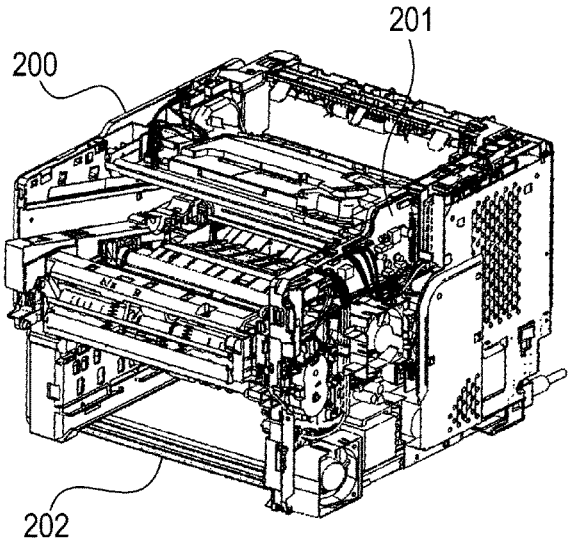
Fig. 17 (CONVENTIONAL ART)
Figure 17:
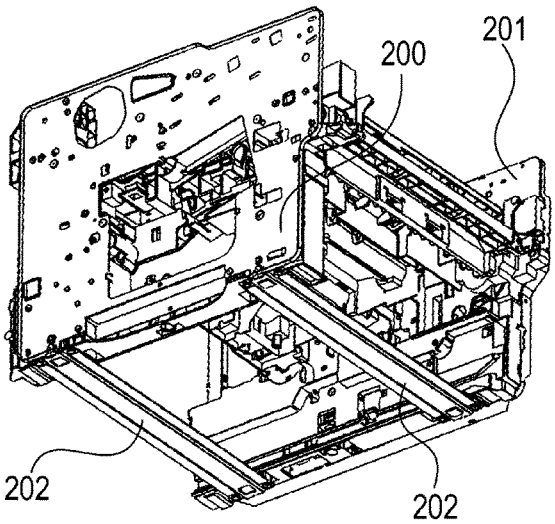
Fig. 17 (CONVENTIONAL ART)
Figure 17:
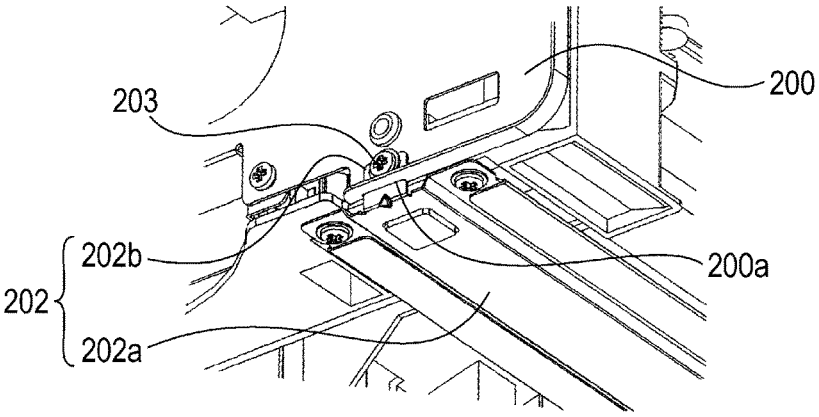
Fig. 17 (CONVENTIONAL ART)

Parts (a), (b) and (c) of FIG. 17 are perspective views of a typical conventional frame for an image forming apparatus.

Figure 18:
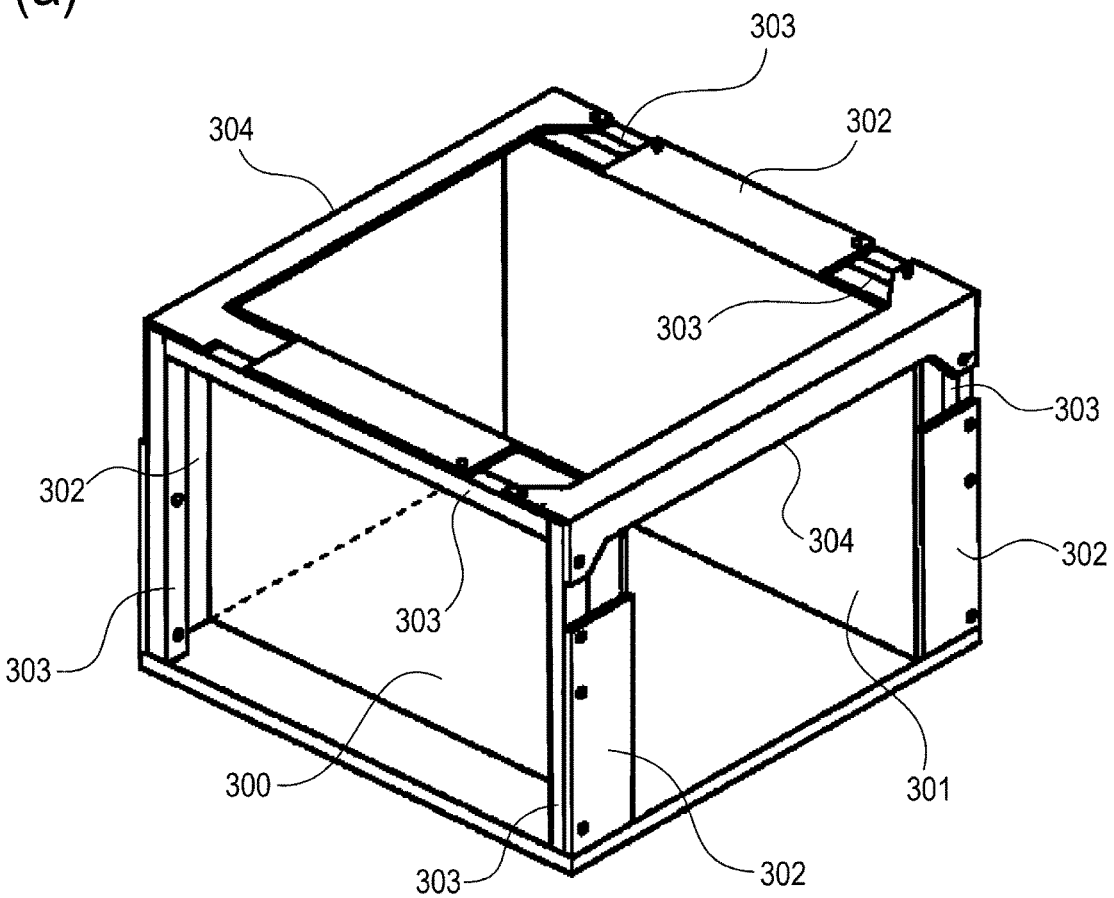
Fig. 18 (CONVENTIONAL ART)
Figure 18:
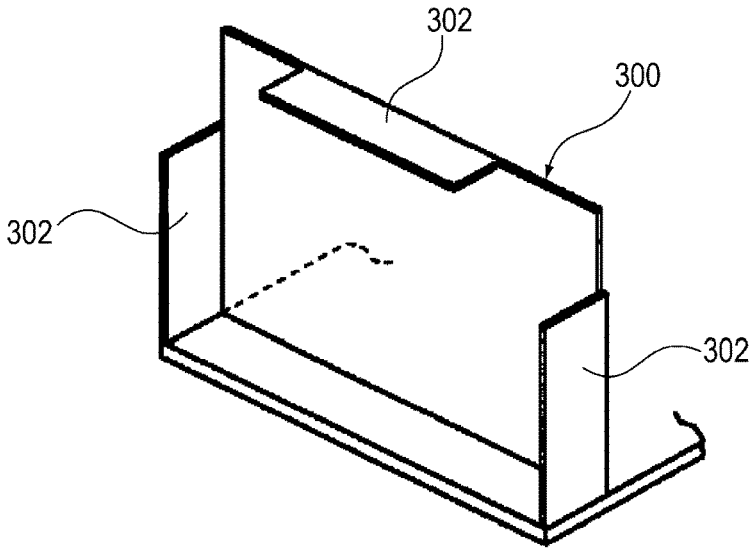
Fig. 18 (CONVENTIONAL ART)

Parts (a) and (b) of FIG. 18 are perspective views of a typical conventional frame for an image forming apparatus.

EMBODIMENTS FOR CARRYING OUT THE INVENTION

Embodiment 1

<Image Forming Apparatus>

Hereinafter, the image forming apparatus in this embodiment is described about its overall structure and operation, with reference to appended drawings. By the way, the measurements, materials, shapes of the structural components of the image forming apparatus, and their positional relationship which are going to be described next, are not intended to limit the present invention in scope, unless specifically noted.

Figure 1:
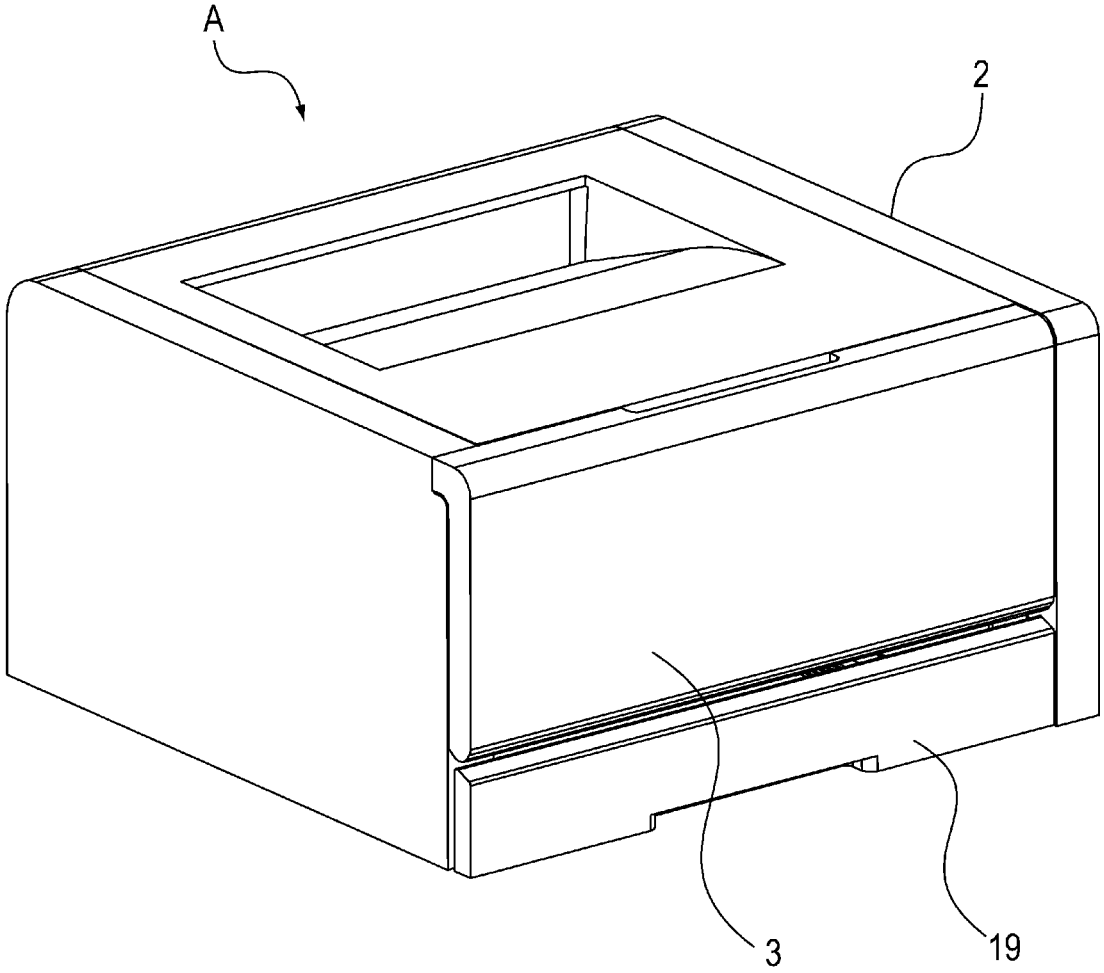
FIG. 1 is a perspective view of the image forming apparatus in the first embodiment of the present invention.
Figure 2:
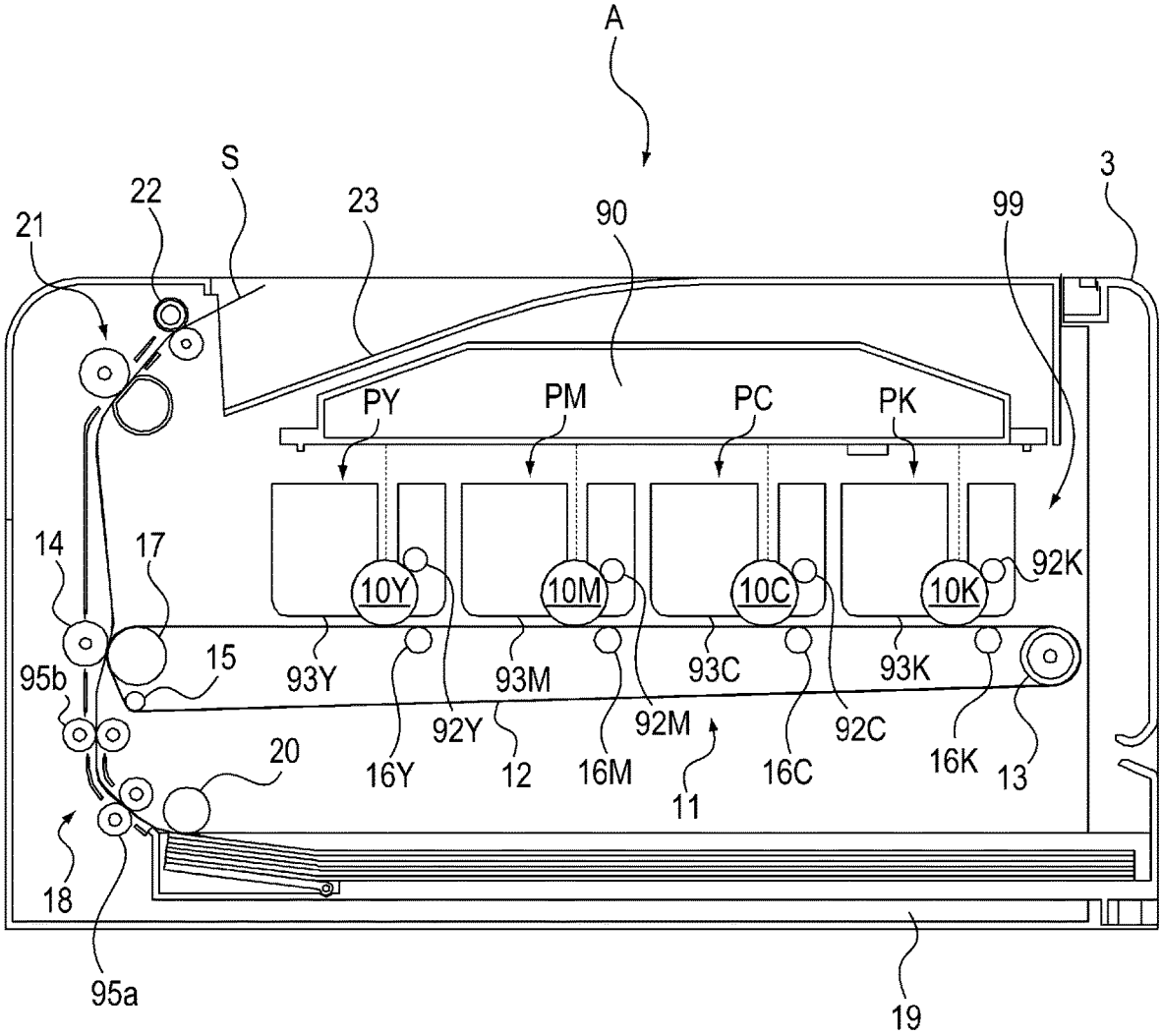
FIG. 2 is a schematic sectional view of the image forming apparatus shown in FIG. 1.

FIG. 1 is a perspective view of the image forming apparatus A in this embodiment. FIG. 2 is a schematic sectional view of the image forming apparatus A. Referring to FIGS. 1 and 2, the image forming apparatus A has: an image forming portion 99 which forms an image on a sheet S of recording medium) by transferring a toner image onto the sheet; and a feeding unit 18 which delivers a sheet of recording medium to the image forming portion 99; and a fixing apparatus 21 which fixes a toner image to a sheet of recording medium.

The feeding unit 18 has: a sheet cassette 19 in which sheets of recording medium are stored in layers; and a feed roller 20. The feed roller 20 feeds the sheets of recording medium into the main assembly of the image forming apparatus A from the sheet cassette 19.

The image forming portion 99 has process cartridges P (PY, PM, PC and PK), an intermediary transfer unit 11, a laser scanner unit 90, primary transfer rollers 16 (16Y, 16M, 16C and 16K), etc. Each process cartridge P has a photosensitive drum 10 (10Y, 10M, 10C or 10K), a charge roller 92 (92Y, 92M, 92C or 92K), and a developing apparatus 93 (93Y, 93M, 93C or 93K).

The intermediary transfer unit 11 has an intermediary transfer belt 12, a tension roller 13, a secondary transfer roller 14, an assist roller 15, and a backup roller 17 which opposes the secondary transfer roller 14. The intermediary transfer belt 12 is suspended by the tension roller 13, backup roller 17, and assist roller 15 in such a manner that it bridges between the adjacent two rollers. It is a flexible endless belt. It is circularly moved by the rotation of the backup roller 17.

The frame 26 (FIG. 3) of the image forming apparatus A is covered with a casing 2. The front side of the image forming apparatus A is provided with a cover 3, which can be opened or closed by being rotationally moved relative to the main assembly of the image forming apparatus A.

Next, the image forming operation of the image forming apparatus A is described. As the unshown controlling portion of the image forming apparatus A receives an image formation job signal, the layered sheets S of recording medium in the sheet cassette 19 are conveyed by a combination of a feed roller 20 and a pair of conveyance rollers 95*a* and 95*b*, to a secondary transferring portion formed by the secondary transfer roller 14 and backup roller 17.

Meanwhile, in the image forming portion, the peripheral surface of the photosensitive drum 10, as a photosensitive member, is uniformly charged by the charge roller 92. Thereafter, the laser scanner unit 90, as an exposing portion, scans the uniformly charged portion of the peripheral surface of the photosensitive drum 10, with a beam of laser light which it projects upon the peripheral surface of the photosensitive drum 10 while modulating the beam with the data of the image to be formed, which are transmitted thereto from un unshown external devices. Consequently, an electrostatic latent image is effected on the peripheral surface of the photosensitive drum 10 as a photosensitive member.

Then, one of the toners which are different in color, is adhered to the electrostatic latent image on the peripheral surface of the photosensitive drum 10, by the developing apparatus 92. As a result, a toner image is formed on the peripheral surface of the photosensitive drum 10.

Then, as the intermediary transfer belt 12 circularly moves, the toner image is sent to the secondary transferring portion by the belt 12. In the secondary transferring portion, bias is applied to the secondary transfer roller 14. As the bias is applied to the secondary transfer roller 14, the toner image on the intermediary transfer belt 12 is transferred onto the sheet S.

After the transfer of the toner image onto the sheet S, the sheet S is heated, while being pressed, by the fixing apparatus 21. Consequently, the toner image on the sheet S is fixed to the sheet S. Thereafter, the sheet S is discharged into a delivery portion 23 by a pair of discharge rollers 22.

<Frame of Image Forming Apparatus>

Next, the structure of the frame 26 of the image forming apparatus A is described.

Figure 3:
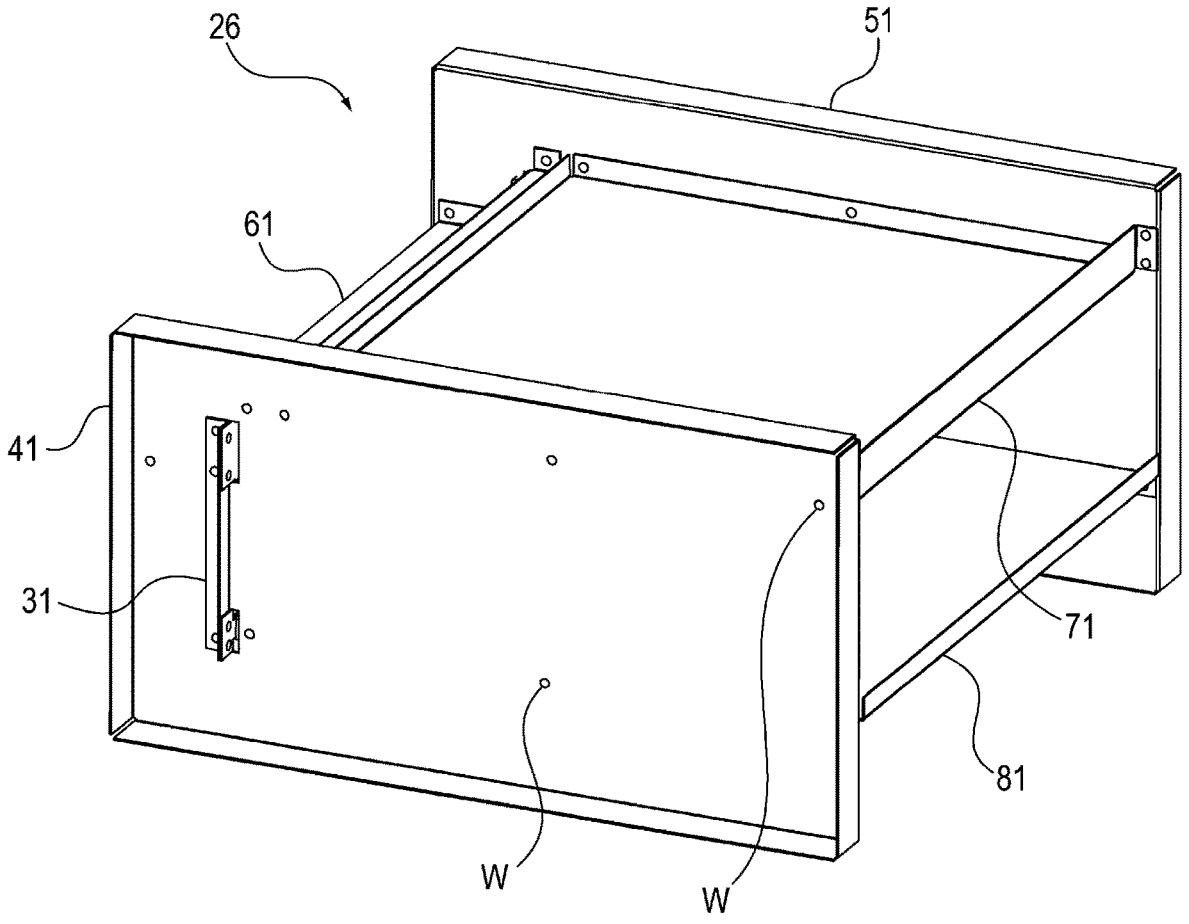
FIG. 3 is a perspective view of the frame of the image forming apparatus shown in FIG. 1.
Figure 4:
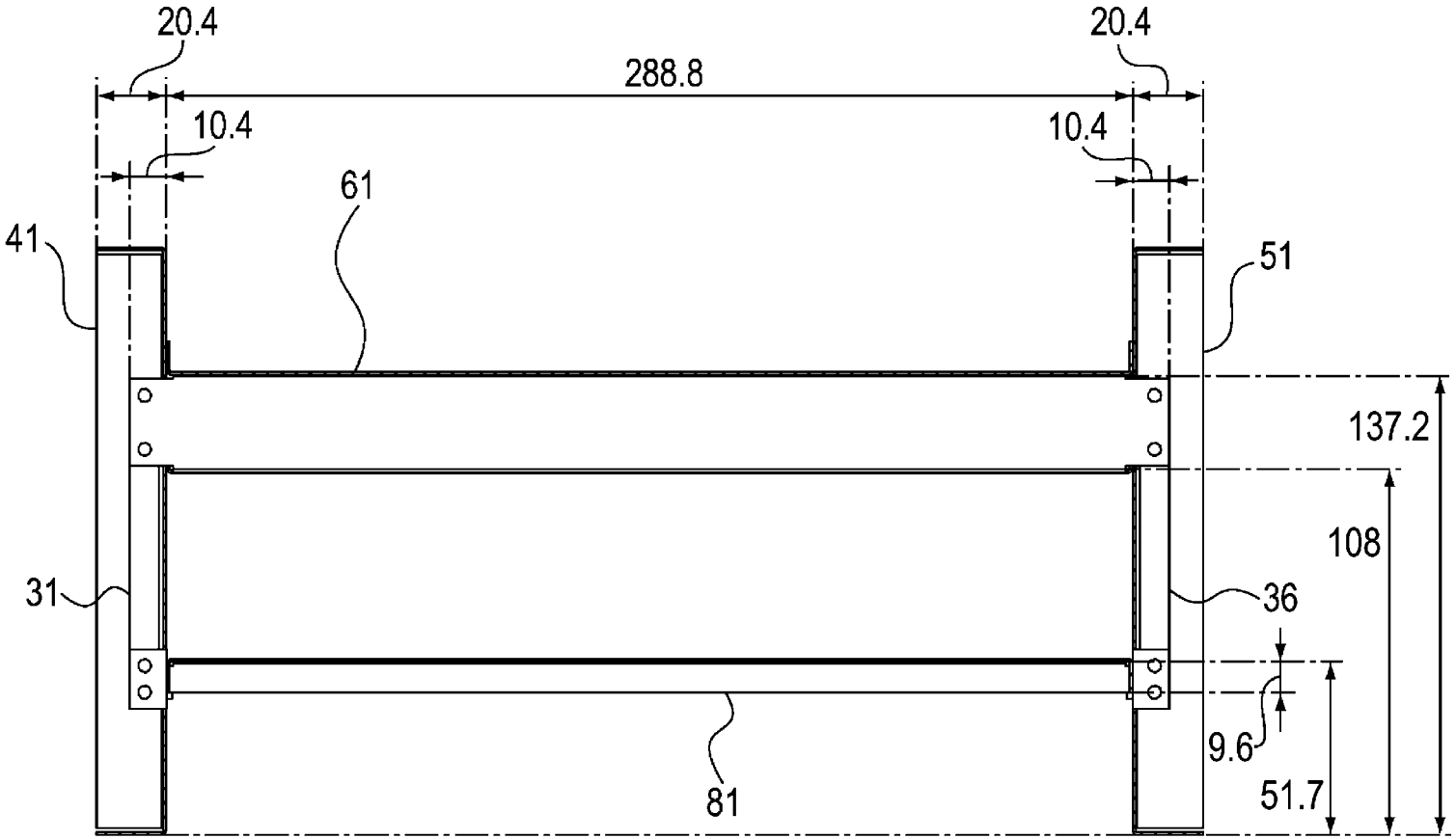
FIG. 4 is a schematic sectional view of the frame of the image forming apparatus shown in FIG. 1.

FIG. 3 is a perspective view of the frame 26 of the image forming apparatus A. FIG. 4 is a schematic sectional view of the frame 26. Referring to FIGS. 3 and 4, the primary structural components of the frame 26 are the left plate 41, right plate 51, fixation stay 61, optics stay 71, and main stay 81. These members are made of metallic plate which is $21\times10^3$ kgf/mm$^2$ in Young's modulus, 0.30 in Poisson's ratio, and 0.8 mm in thickness. They were formed into their appropriate shapes by pressing or the like method. The measurements of these members are as shown in FIG. 4.

The left plate 41 as the first plate, and the right plate 51 as the second plate, are positioned so that they are roughly parallel to each other, and oppose each other. The left plate 41 is provided with a pair of through holes 41*a* and 41*b*. The right plate 51 is provided with a pair of through holes 51*a* and 51*b*.

The fixation stay 61 as the fourth metallic plate, optics stay 71 as the fifth metallic plate, and main stay 81 as the third metallic plate, are positioned between the left plate 41 and right plate 51 in terms of the direction of the rotational axis of the photosensitive drum 10. They are in connection to the left plate 41 and right plate 51. The optics stay 71 as the fifth metallic plate, is a member for supporting the laser scanner unit 90. The main stay 81 as the third metallic plate, is a member for supporting the intermediary transfer unit 11 and connector 18. The fixation stay 61 as the fourth metallic plate is a member for supporting the fixing apparatus 21.

To the left plate 41 as the first metallic plate, an L-angle 31, which is a fixing member, and also, the first fixing member, is fixed. To the right plate 51 as the second metallic plate, an L-angle 36 as the second fixing member (FIG. 8), is fixed. The structure and function of the L-angles 31 and 36 are described later.

Figure 5:
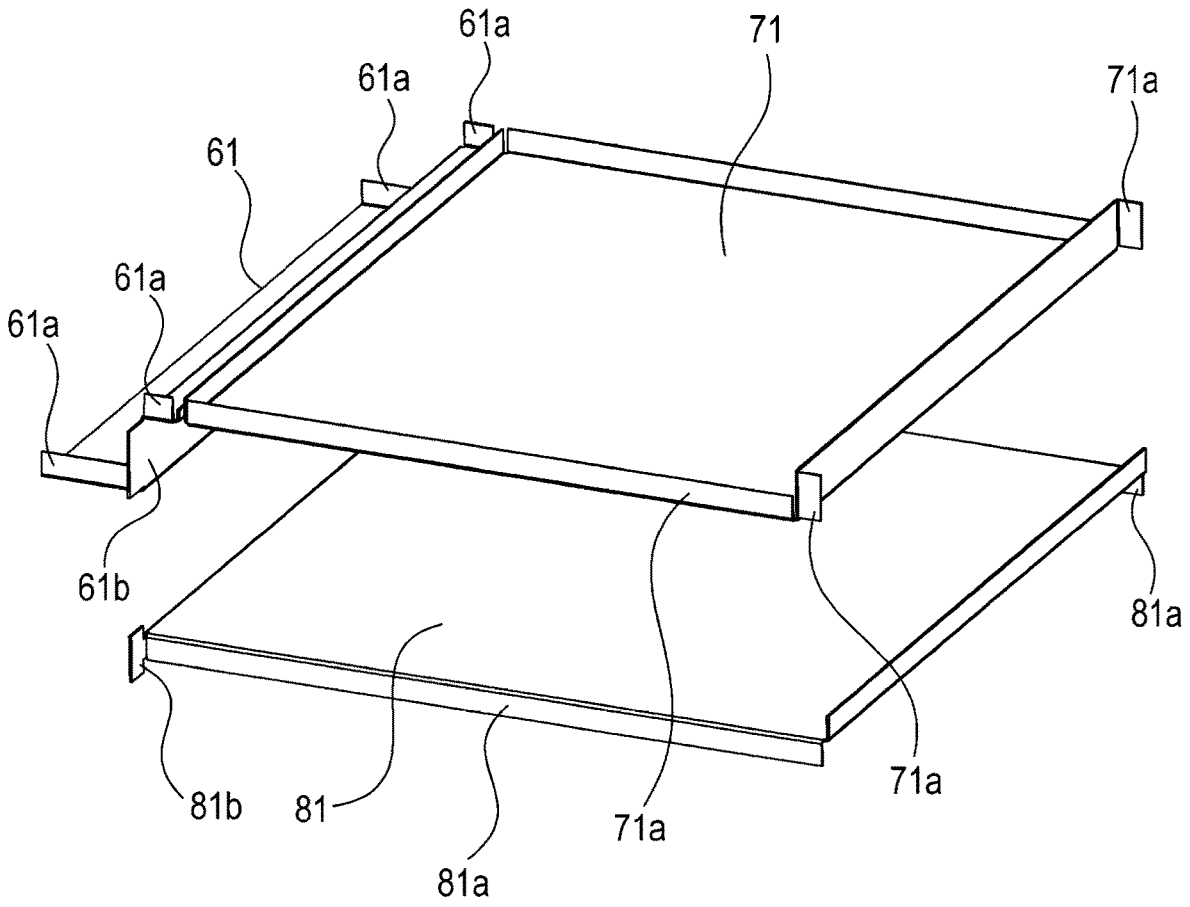
FIG. 5 is a perspective view of a combination of the fixation stay, optics stay, and main stay of the image forming apparatus shown in FIG. 1.

FIG. 5 is a perspective view of a combination of the fixation stay 61, optics stay 71 and main stay 81. As is evident from FIG. 5, the fixation stay 61, optics stay 71 as the fifth metallic plate, and main stay 81 are provided with bent portions 61*a*, 71*a* and 81*a*, which were bent so that after their insertion into the through holes 41*a*, 41*b*, 51*a* and 51*b*, respectively, they will be roughly parallel to the left plate 41 as the first metallic plate, and right plate 51 as the second metallic plate.

The bent portion 61*a* of the fixation stay 61, bent portion 71*a* of the optics stay 71, and bent portion 81*a* of the main stay 81 are spot-welded to left plate 41 as the first metallic plate 41, right plate 51 as the second metallic plate, at spots W (FIG. 3, etc.), whereby the fixation stay 61 as the fourth metallic plate, optics stay 71 as the fourth metallic plate as the fifth metallic plate, and main stay 81 as the third metallic plate, are connected to the left plate 41 and right plate 51.

The fixation stay 61 as the fourth metallic plate, has a perpendicular portion 61*b*, which is perpendicular to the main portion of the fixation stay 61. Each of the lengthwise end portions of the vertical portion 61*b* is outwardly protrusive beyond the corresponding bent portion 61*a*.

Further, the main stay 81 as the third metallic plate, has a portion 81*b* which is vertical and coincides with the vertical portion 61*b*. Each of the lengthwise end portions of the vertical portion 81*b* is outwardly protrusive beyond the corresponding bent portion 81*a*.

Figure 6:
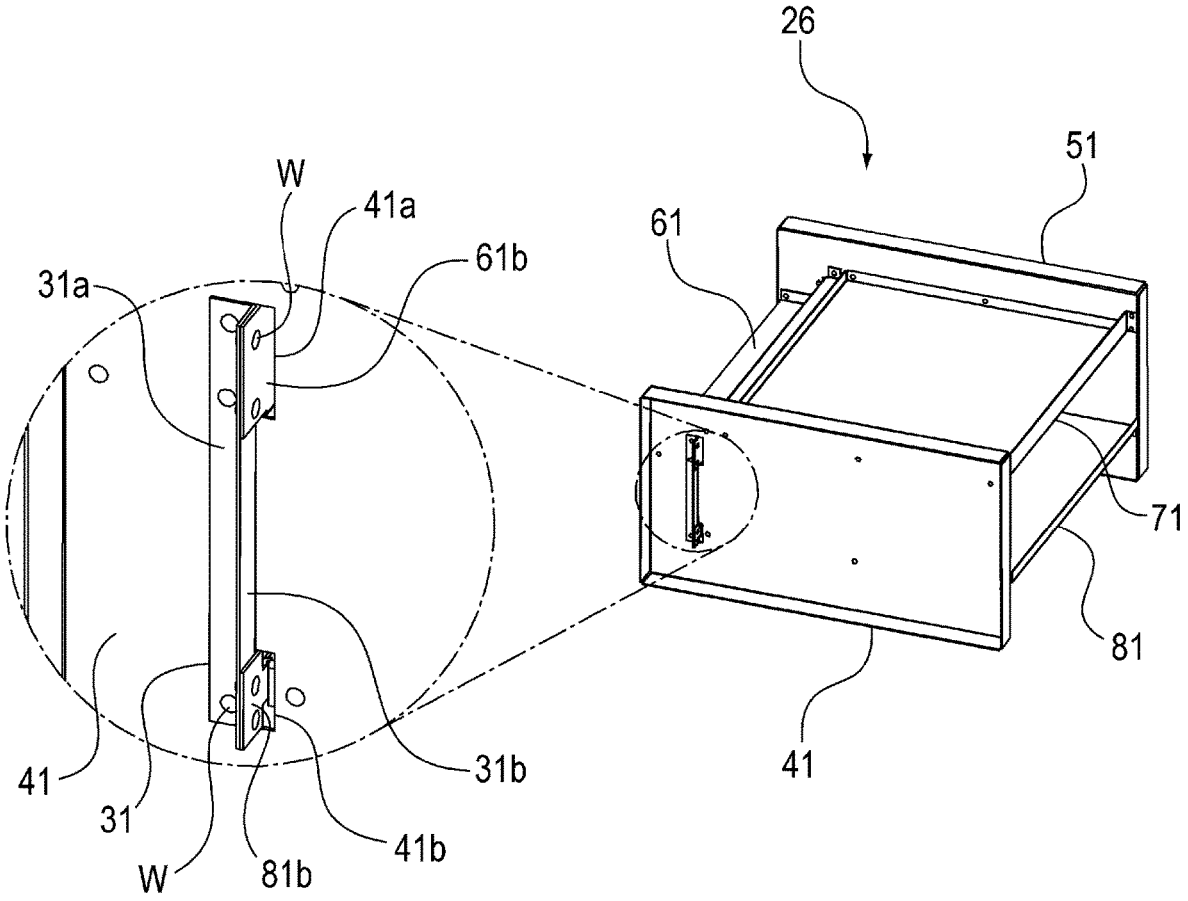
FIG. 6 is a combination of a perspective view the frame shown in FIG. 3, and an enlarged perspective view of one of the L-angles of the frame.

FIG. 6 is a combination of a perspective view of the frame 26, and an enlarged perspective view of one of the L-angles 31. As shown in FIG. 6, each of L-angles 31, which is a fixing member as well as the first fixing member, has the first fixing portion 31*a*, which is parallel to the portion of the left plate 41, which is provided with the through holes 41*a* and 41*b*. The first fixing portion 31*a* is fixed to the left plate 41. The first fixing portion 31*a* is fixed to the opposite surface of the left plate 41 from the right plate 51. It has the second fixing portion 31*b*, which is intersectional to the portion of the left plate 41, which is provided with the through holes 41*a* and 41*b*. The second fixing portion 31*b* as the second portion, is perpendicular to the first fixing portion 31*a* as the first portion. It is perpendicular to the portion of the left plate 41, which is provided with the through holes 41*a* and 41*b*.

The vertical portion 61*b* of the fixation stay 61 is outwardly put through the through hole 41*a* of the left plate 41, and is fixed to the second fixing portion 31*b* of the L-angle 31 which is also the first fixing member. Here, the vertical portion 61*b* is parallel to the second fixing portion 31*b* as the second portion. Therefore, the second fixing portion 31*b* as the second portion, and vertical portion 61*b*, form such a portion that is parallel to the normal line to the left plate 41 which is provided with the through holes 41*a* and 41*b*.

The vertical portion 81*b* of the main stay 81 is outwardly put through the through hole 41*b* of the left plate 41, and is fixed to the second fixing portion 31*b* of the L-angle 31, which is a fixing member and the first fixing member as well. Here, the vertical portion 81*b* is such a portion that is parallel to the second fixing portion 31*b* as the second portion. Therefore, the vertical portion 81*b*, and second fixing portion 31*b* as the second portion, form such a portion that is parallel to the normal line to the left plate 41, which is provided with the through holes 41*a* and 41*b*.

Figure 8:
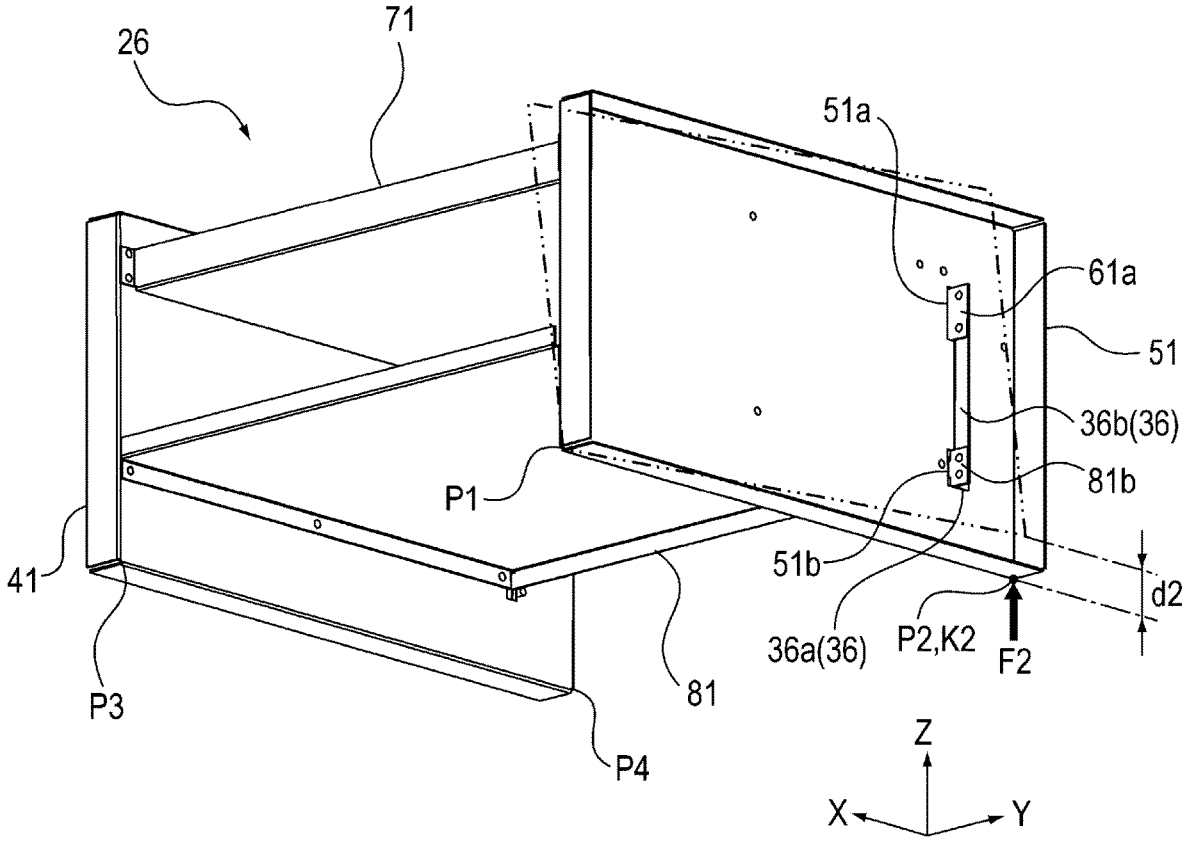
FIG. 8 is a perspective view of the frame.

The L-angle 36 shown in FIG. 8 is the same in structure as the L-angle 31. That is, the L-angle 36 as the second fixing member, has the first fixing portion 36*a* as the third surface portion, which is parallel to the right plate 51, which is provided with the through holes 51*a* and 51*b*, and is fixed to the right plate 51. The first fixing portion 36*a* is fixed to the opposite surface of the right plate 51 from the left plate 41. Further, it has the second fixing portion 36*b* as the fourth portion, which is intersectional to the portion of the right plate 51, which has the through holes 51*a* and 51*b*. The second fixing portion 36*b* as the fourth portion, is such a portion that is perpendicular to the first fixing portion 36*a* as the third portion. It is perpendicular to the portion of the right plate 51, which is provided with the through holes 51*a* and 51*b*.

The vertical portion 61*b* of the fixation stay 61 is outwardly protrusive through the through hole 51*a*, and is fixed to the second fixing portion 36*b* of the L-angle 36 as the second fixing member. Here, the vertical portion 61*b* is such a portion that is parallel to the second fixing portion 36*b* as the fourth portion. Therefore, a combination of the vertical portion 81*b* and second fixing portion 36*b* forms a portion that is normal to the portion of the right plate 51, which is provided with the through holes 51*a* and 51*b*.

Further, the vertical portion 81*b* of the main stay 81 is outwardly protrusive beyond the right plate 51 through the through holes 51*a* and 51*b* of the right plate 51. It is fixed to the second fixing portion 36*b* of the L-angle 36 as the second fixing member. Here, the vertical portion 81*b* is parallel to the second fixing portion 36*b* as the fourth portion. Therefore, a combination of the vertical portion 81*b* and second fixing portion 36*b* forms such a portion that is normal to the portion of the right plate 51, which is provided with the through holes 51*a* and 51*b*.

<Effects of External Force Upon Frame>

Next, the effects of external force upon the frame 26 are described.

Figure 7:
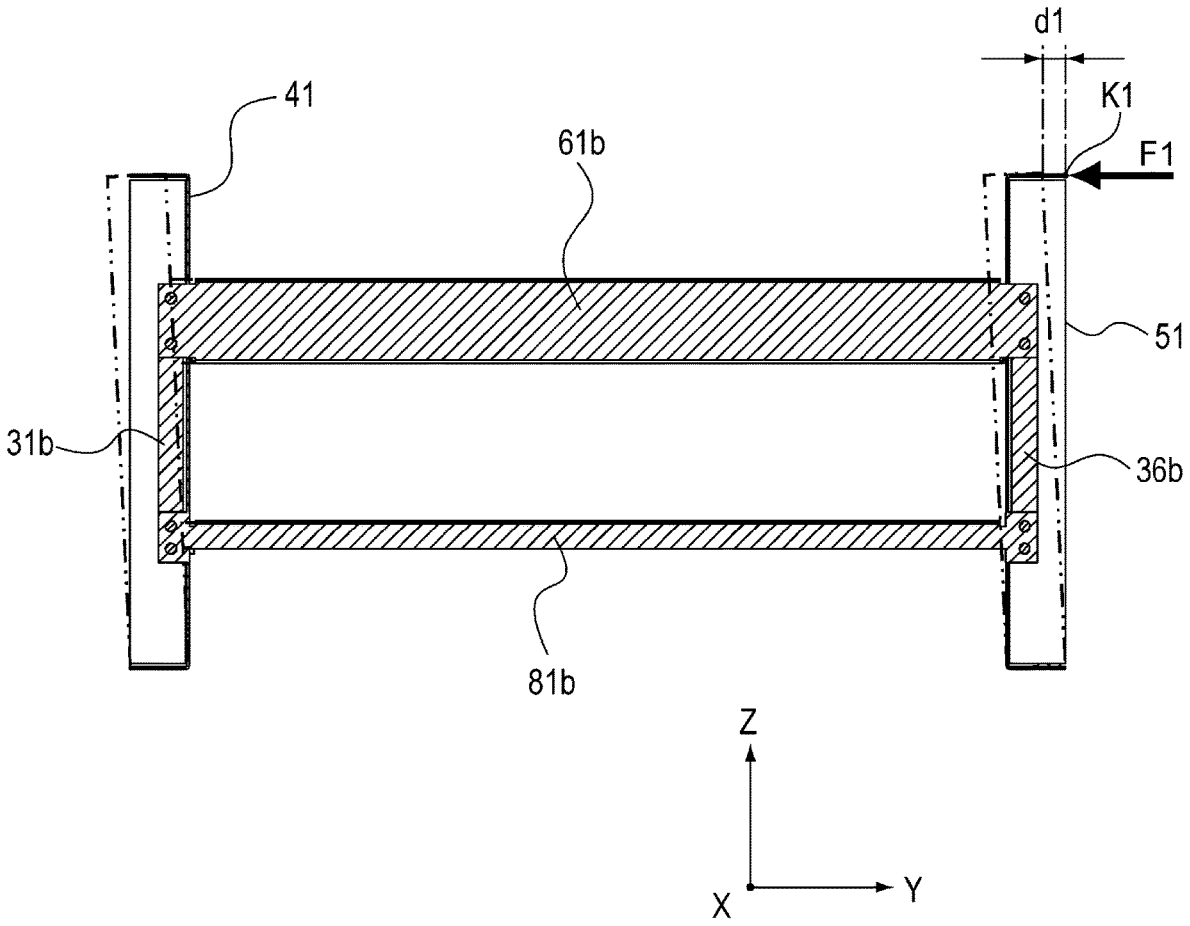
FIG. 7 is a schematic sectional view of the portions of the frame in the first embodiment, to which the present invention concerns.

FIG. 7 is a schematic sectional view of the frame 26 at a plane which is in the adjacencies of the second fixing portion 31*b* of the L-angle 31. It is assumed there that an external force F1 acts upon a point K1 of the top edge portion of the right plate 51, in the thickness direction (indicated by arrow mark Y) of the right plate 51.

In this case, the bent portions 61*a*, 71*a* and 81*a* are subjected to the external force F1 which is parallel to the thickness direction of the bent portions 61*a*, 71*a* and 81*a*. Thus, these portions deform, and change in angle. Consequently, fixation stay 61, optics stay 71, and main stay 81 change in position relative to the left plate 41 and right plate 51. Further, the force bearing point K1 of the right plate 51 moves in the direction indicated by the arrow mark Y. As they change in position relative to the left plate 41 and right plate 51, the image forming apparatus A changes in the positional relationship between the laser scanner unit 90 as the exposing portion, and therefore, is likely to output unsatisfactory images.

In this embodiment, however, the frame 26 is provided with the L-angle 31 and L-angle 36, and the vertical portion 81*b* of the main stay 81 is fixed to the second fixing portions 31*b* and 36*b* of the L-angles 31 and 36, respectively, as described above. Therefore, as the point K1 is subjected to the external force F1, which is perpendicular to the thickness direction of the right plate 51, it is borne by the combination of the second fixing portion 31*b*, second fixing portion 36*b*, vertical portion 61*b*, and vertical portion 81*b*, which resists the external force F1, which is perpendicular to the thickness direction of these portions.

As described above, metallic plate easily deforms in its thickness direction, but it does not easily deform in the direction which is perpendicular to its thickness direction. Therefore, the combination of the second fixing portions 31*b* and 36*b*, and vertical portion 61*b* and 81*b* is resistant to the external force F1 which is perpendicular to the thickness direction of these portions. Therefore, the bent portions 61*a*, 71*a*, and 81*a* are prevented from deforming. Therefore, it is possible to reduce the image forming apparatus A in the amount of change in the positional relationship of the fixation stay 61, optics stay 71, and main stay 81 relative to the left plate 41 and right plate 51. Therefore, it is possible to prevent the image forming apparatus A from undesirably changing in the positional relationship between the laser scanner unit 90 and photosensitive drum 10. Therefore, it is possible to prevent the image forming apparatus A from outputting defective images, the defects of which are attributable to the undesirable positional relationship between the laser scanner unit 90 and photosensitive drum 10.

Figure 9:
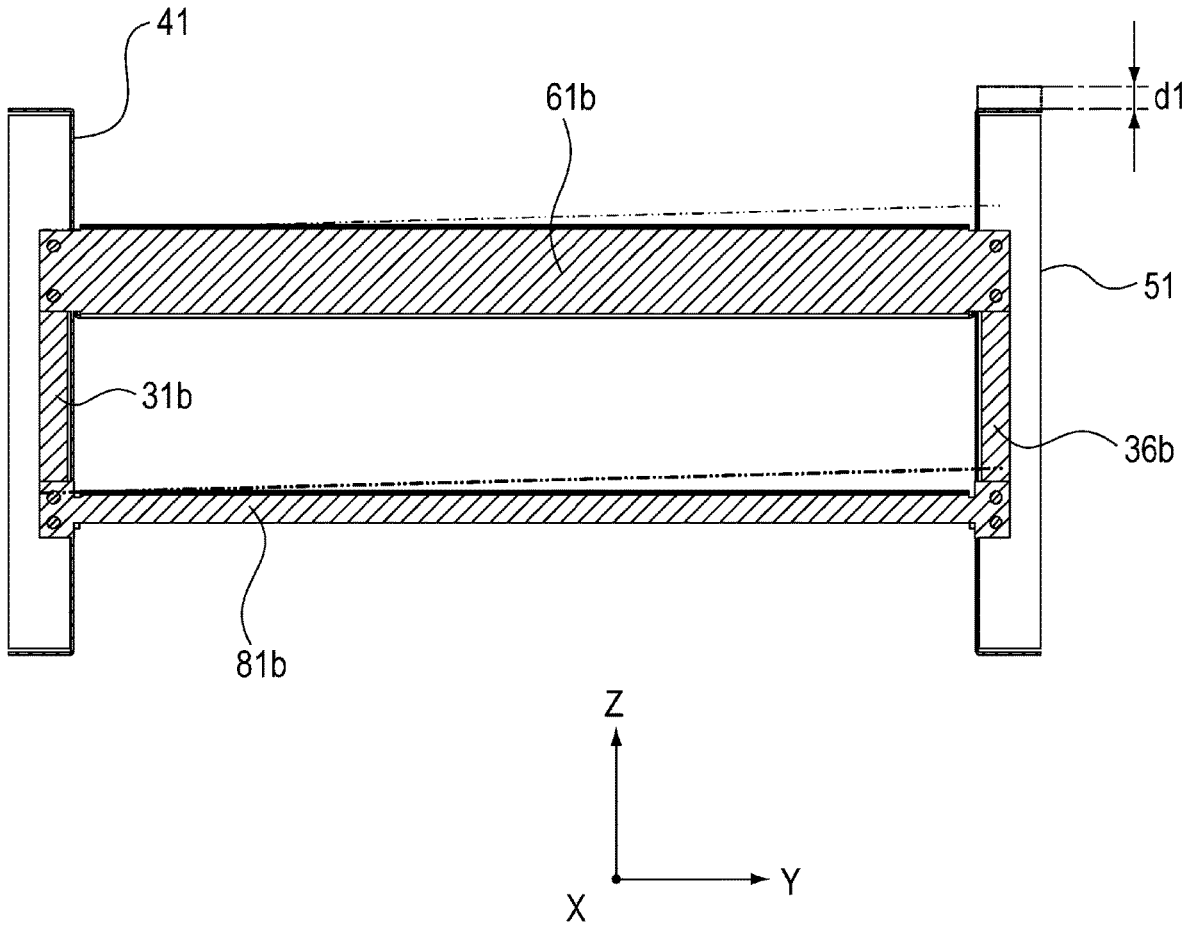
FIG. 9 is a schematic sectional view of the frame.

FIG. 8 is a perspective view of the frame 26. FIG. 9 is a schematic sectional view of the frame 26. Referring to FIGS. 8 and 9, it is assumed there that a point K2, which is a part of the bottom edge portion of the right plate 51 is subjected to an external force F2, which is vertical in direction (indicated by arrow mark Z).

In this case, the external force F2 which is parallel to the thickness direction of bent portions 61*a*, 71*a*, and 81*a* acts on the fixation stay 61, optics stay 71, and main stay 81. Thus, the fixation stay 61, optics stay 71, and main stay 81 are twisted, causing the right plate 51 to move upward. As a result, the image forming apparatus A changes in the positional relationship of the fixation stay 61, optics stay 71, and main stay 81 relative to the right plate 51 and left plate 41. As the image forming apparatus A changes in this positional relationship, the positional relationship between the laser scanner unit 90 as the exposing portion, and the photosensitive drum 10 as the photosensitive member, is disturbed, which is likely to cause the image forming apparatus A to output unsatisfactory images.

In this embodiment, however, a combination of the vertical portion 61*b* of the fixation stay 61, and the vertical portion 81*b* of the main stay 81, second fixing portion 31*b* of the L-angle 31, and second fixing portion 36*b* of the L-angle 36 acts like a solid one-piece sub-frame, and bears the external force F2 which is perpendicular to the thickness direction of the fixation stay 61 and main stay 81, and resists the external force F2. Therefore, it is possible to prevent the fixation stay 61, optics stay 71, and main stay 81 from being twisted, and/or the right plate 51 from being moved upward. In particular, in the case of an image forming apparatus which is structured so that a sheet S of recording medium is conveyed from the bottom side of the main stay 81 to the top side of the main stay 81, modifying the apparatus in structure so that the sheet S passes by the lengthwise end of the main stay 81, which is provided with the vertical portion 81*b*, is more effective to prevent the deformation. Therefore, it is possible to prevent the image forming apparatus A from being undesirably affected in the positional relationship between the laser scanner unit 90 and photosensitive drum 10. Therefore, it is possible to prevent the image forming apparatus A from outputting defective images, the defects of which are attributable to the undesirable change in the positional relationship between the laser scanner unit 90 and photosensitive drum 10, described above.

<Results of Analysis Based on FEM>

Next, results of analysis of the frame of the image forming apparatus A in this embodiment, and the frame of a comparative example of image forming apparatus, in terms of an amount (FIG. 7) by which the point K1 moved in the direction indicated by the arrow mark Y when the external force F1 acted upon the point K1, and an amount d2 (FIG. 8) by which the point K2 moved in the direction indicated by the arrow mark Z when the external force F2 acted upon the point K2, are described. The analysis was done with the use of FEM (finite element method).

Figure 16:
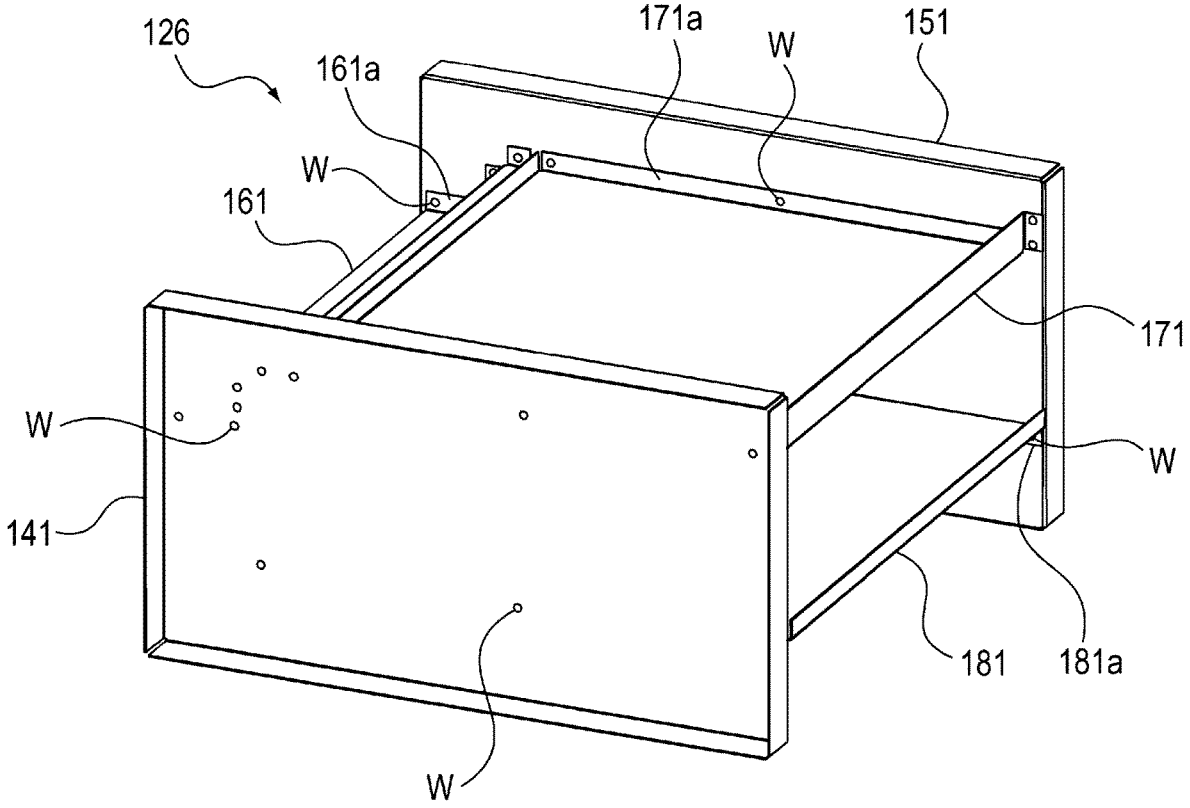
Fig. 16 (CONVENTIONAL ART)
FIG. 16 is a perspective view of a typical conventional frame for an image forming apparatus.

FIG. 16 is a perspective view of the frame 126 of a comparative example of image forming apparatus. As is evident from FIG. 16, the frame 126 of the comparative example is different in structure from the frame 26 in this embodiment. It does not have the L-angles 31 and 36. Its fixation stay 161 and main stay 181 are in connection to the left plate 141 and right plate 151, only by being welded to the plates 141 and 151. Otherwise, the frame 126 is the same in structure as the frame 26 in the first embodiment. That is, it is the same as the frame 26, in the type of metallic plate, of which it is made, thickness of the metallic plate, and measurements.

During this analysis, points P1-P4 (FIG. 8) of the frame 26, by which the frame 26 contacted the surface on which the frame 26 was placed, were kept under the following constraint: P1 was constrained in the movement in the direction indicated by an arrow mark Z; P2 in the direction indicated by the arrow mark Z when d1 was measured, but no constraint in the direction indicated by the arrow mark Z when d2 was measured; P3 in the directions indicated by the arrow marks Y and Z; and P4 was constrained in the directions indicated by the arrow marks X, Y and Z.

The results of the analysis revealed the followings: In the case of the comparative frame 126, when F1=1 kgf; F2=1 kgf; and the total weight of the frame 126 was 2170 g, d1=0.45 mm, and d2=10.7 mm. In comparison, in the case of the frame 26 in this embodiment, when F1=1 kgf, and F2=1 kgf, d1=0.21 mm and d2=7.2 mm.

Further, in the case of the frame 26 in this embodiment, as the metallic plate, of which frame 26 was made, was changed in thickness from 0.8 mm to 0.7 mm, the total weight of the frame 26 changed to 1919 g (7.85 g/cm$^3$; d1=0.30 mm; d2=10.3 mm.

It was confirmed from the results of the analysis based on FEM that deformation of the frame 26 was prevented by structuring the frame 26 as described above. Further, it was confirmed that even though the metallic plate, of which the frame 26 in this embodiment was made, was less in thickness than the comparative frame 126, the structure of the frame 26 in this embodiment was more effective to prevent the frame deformation than the structure of the comparative frame 126.

By the way, regarding the structure of the frame 26 in this embodiment, the deformation of the frame 26 can be prevented, even if the frame 26 is structured so that the vertical portion 61*b* of the fixation stay 61, and the second fixing portion 31*b* of the L-angle 31, are fixed to each other through the left plate 41. Similarly, the deformation of the frame 26 can be prevented, even if the frame 26 is structured so that the vertical portion 61*b* of the fixation stay 61, and the second fixing portion 36*b* of the L-angle 36, are fixed to each other through the right plate 51.

Figure 10:
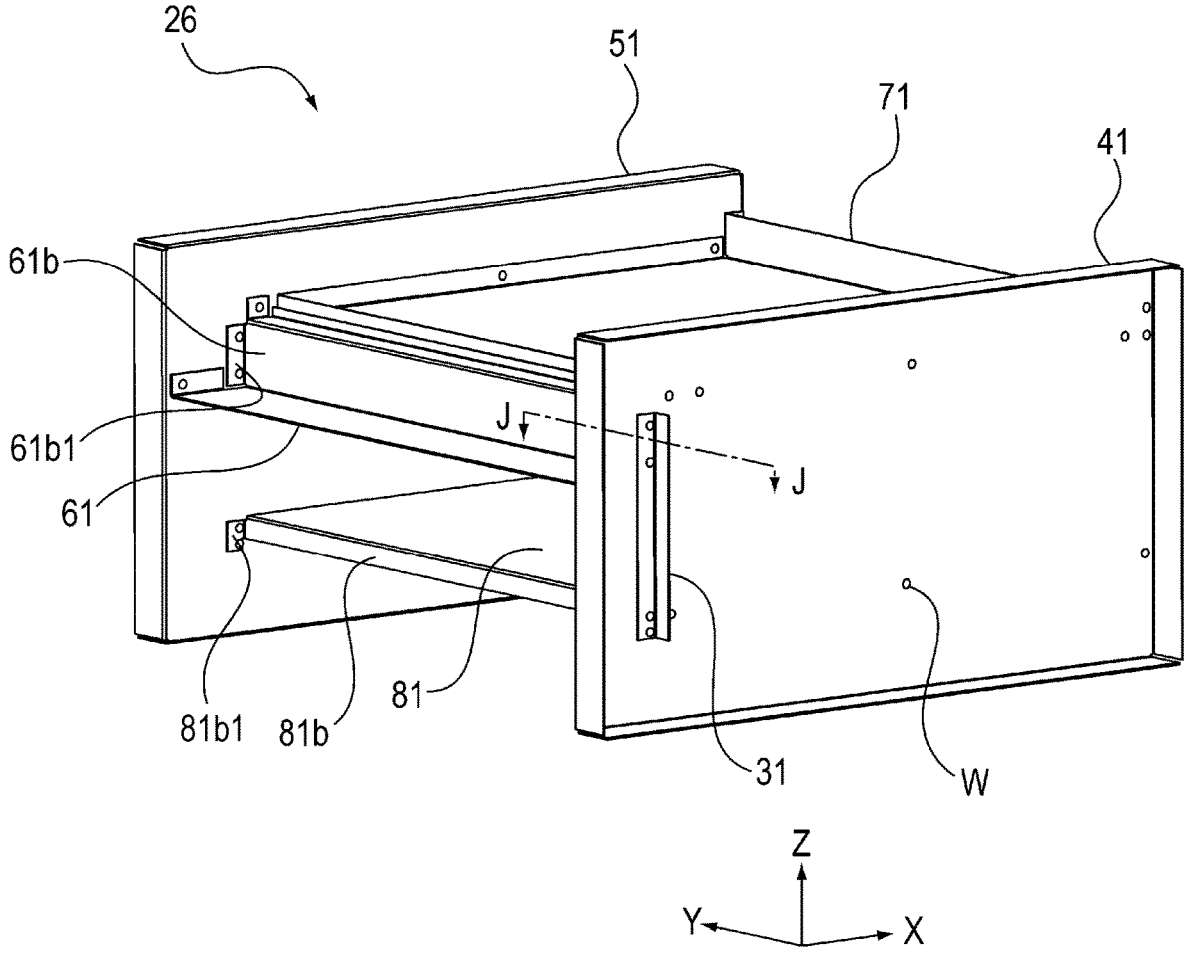
FIG. 10 is a perspective view of another frame.
Figure 11:
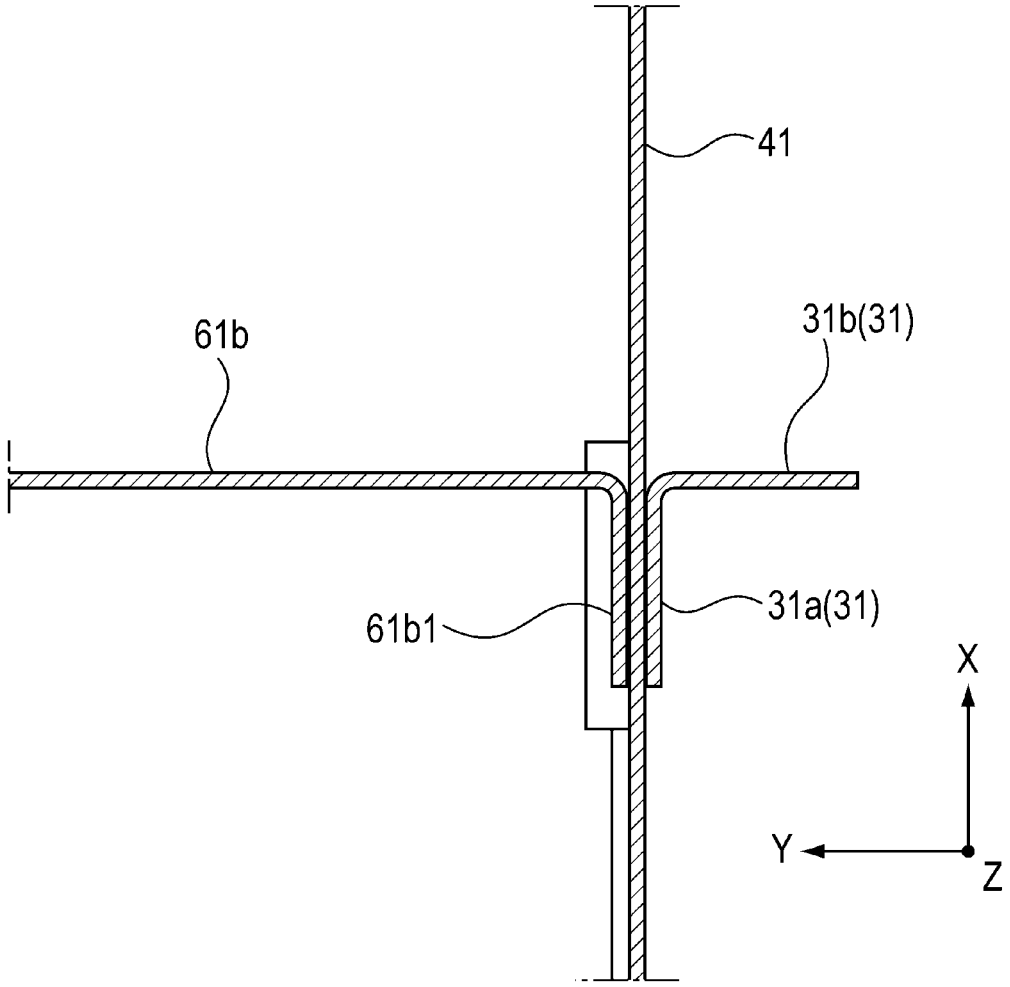
FIG. 11 is a sectional view of another frame.

FIG. 10 is a perspective view of the frame 26 structured as described above. FIG. 11 is a sectional view of the frame 26, at a plane J-J in FIG. 10.

It shows the structure of the frame 26. Referring to FIGS. 10 and 11, the lengthwise end portions of the vertical portion 61*b* of the fixation stay 61 are provided with a bent portion 61*b*1, which was formed by bending the lengthwise end portion of the vertical portion 61*b*, in the direction which is roughly parallel to the first fixing portion 31*a* of L-angle 31 of the left plate 41, and the first fixing portion 36*a* of the L-angle 36. Further, the lengthwise ends of the vertical portion 81*b* of the main stay 81 are provided with bent portions 81*b*1, which was formed by bending the lengthwise end portions in the direction which is roughly parallel to the portion of the left plate 41, to which the first fixing portion 31*a* of the L-angle 31 is fixed, and the portion of the right plate 51, to which the first fixing portion 36*a* of the L-angle 36 is fixed.

The bent portions 61*b*1 and 81*b*1 are fixed to the left plate 41 and right plate 51 by their base portion. The first fixing portion 31*a* as the first portion of the L-angle 31, is welded to the left plate 41, by its base portion, that is, the bend portion of the L-angle 31. The first fixing portion 36*a* as the third portion of the L-angle 36, is welded to the right plate 51 by their base portion, that is, the portion which is adjacent to the border line between the main portion of the L-angle 36, and the first fixing portion 36*a*.

Since the frame 26 is structured as described above, a combination of the second fixing portions 31*b* and 36*b*, and the vertical portions 61*b* and 81*b* are put in a state which is similar to the one in which they are directly connected to each other. Therefore, as the external force F1 or external force F2 acts on the aforementioned points of the frame 26 (FIGS. 7 and 8), the second fixing portion 31*b* and 36*b*, and vertical portion 61*b* and 81*b*, bear the external force F1 and F2, which are perpendicular to the thickness direction of the fixation stay 61 and main stay 81, and resists the external force F1 and F2. Therefore, it is possible to prevent the deformation of the frame 26.

Embodiment 2

Next, the structure of the image forming apparatus in the second embodiment of the present invention is described. The portions of the frame in this embodiment, which are the same in description as the counterparts of the frame in the first embodiment, are given the same referential codes, and are not described here.

Figure 12:
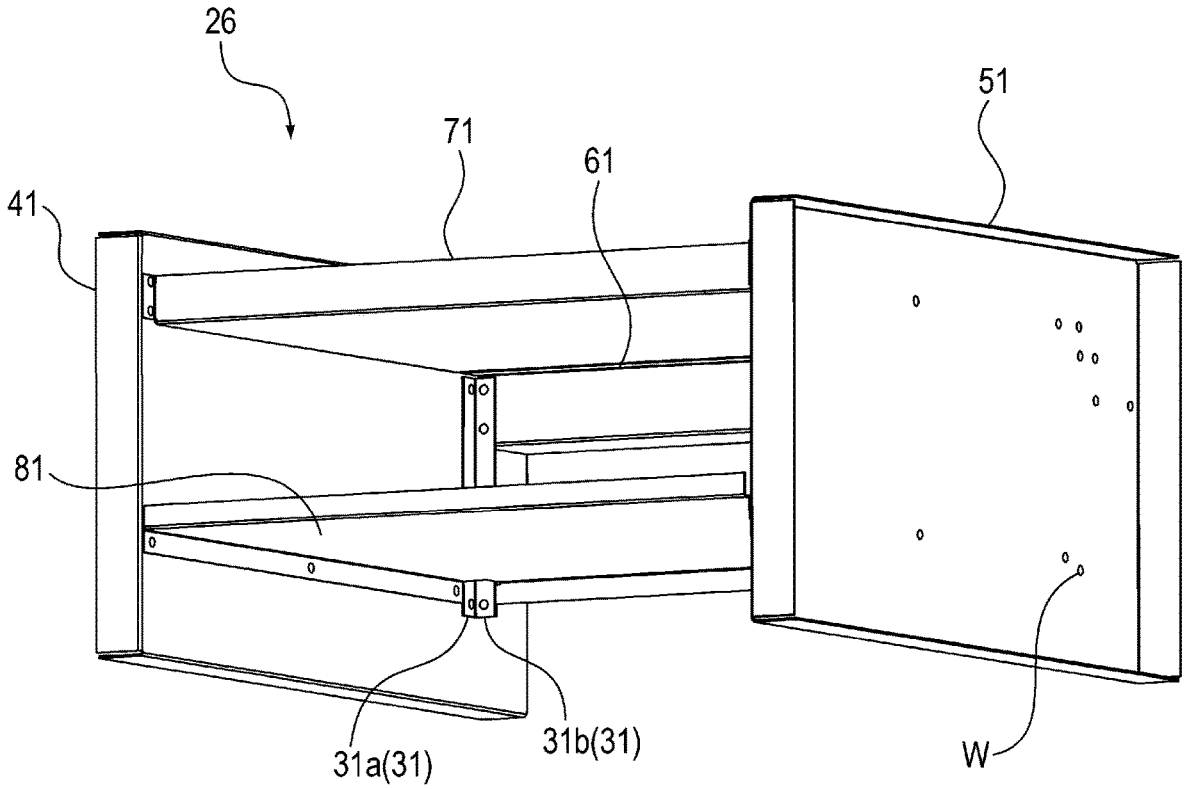
FIG. 12 is a perspective view of the frame.

FIG. 12 is a perspective view of the frame 26 in this embodiment. As shown in FIG. 12, the frame 26 in this embodiment is similar in structure to the frame 26 in the first embodiment, except that the L-angle 31, which is a fixing member, and also, the first fixing member, is fixed to the inward surface of the left plate 41, and the L-angle 36 as the second fixing member, is fixed to the inward surface of the right plate 51.

With the frame 26 being structured as described above, the second fixing portion 31*b* and 36*b* of the L-angles 31 and 36, respectively, by which the L-angles 31 and 36 are fixed to the fixation stay 61 as the fourth metallic plate, and the main stay 81 as the third metallic plate, are on the inward side of the left plate 41 and right plate 51, respectively. Therefore, even if other members of the image forming apparatus A are on the outward side of the left plate 41 and/or right plate 51, the L-angles 31 and 36 do not interfere with them. In other words, this embodiment affords more latitude in the positioning of other members.

Further, the only structural difference of the frame 26 in this embodiment from the frame 26 in the first embodiment is that the two frames 26 are different in the position at which external forces are borne by the left and right plates 41 and 51. In terms of the mechanism by which the frame 26 resists the external forces F1 and F2 (FIGS. 7 and 8), the two frames 26 are the same. That is, the structural design, in this embodiment, for the frame 26 can also prevent the deformation of the frame 26.

Embodiment 3

Next, the structure of the image forming apparatus in the third embodiment of the present invention is described. The portions of the image forming apparatus, which are the same in description as the counterparts in the first and second embodiments are given the same referential codes, and are not described.

Figure 13:
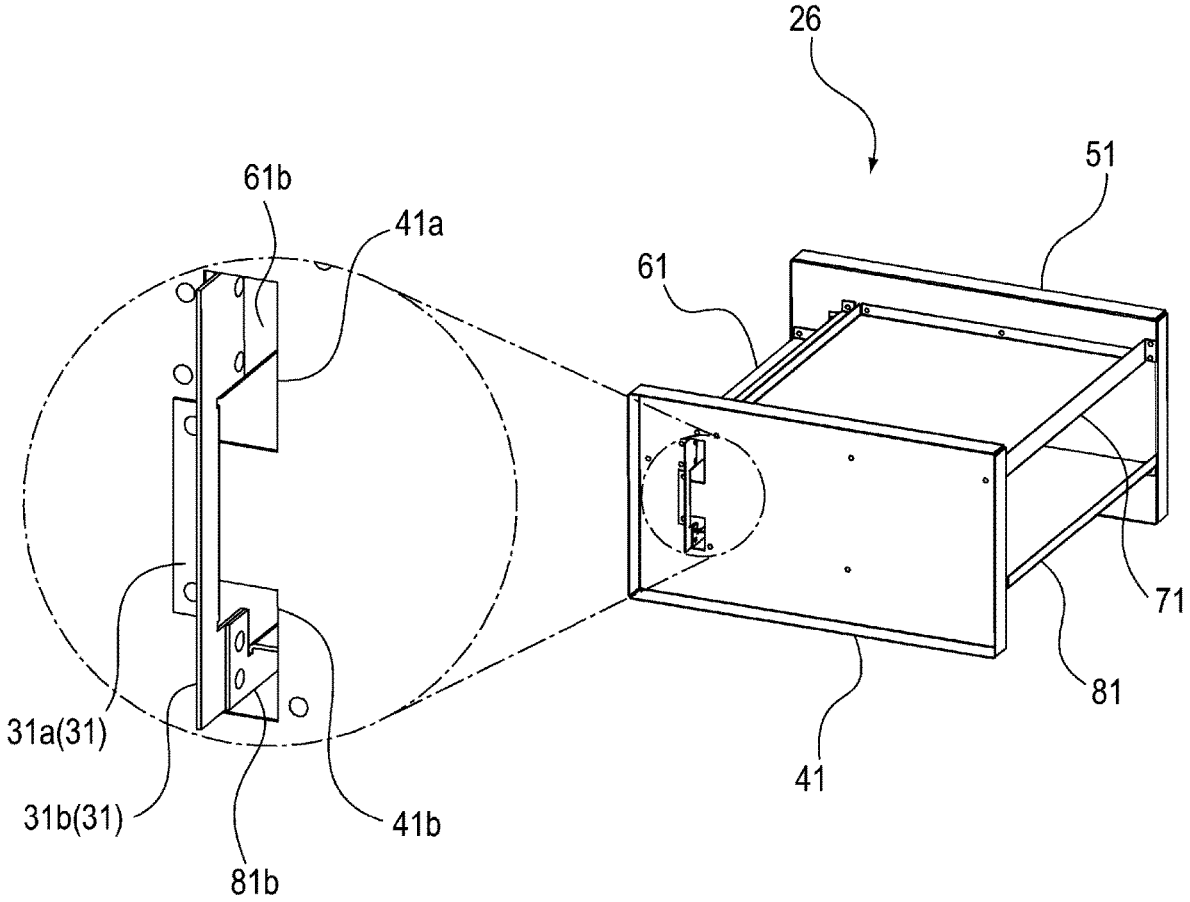
FIG. 13 is a perspective view of the frame.

FIG. 13 is a perspective view of the frame 26 in this embodiment. As shown in FIG. 13, in the case of the frame 26 in this embodiment, the second fixing portion 31*b* of the L-angle 31, which is a fixing member, and also, is the first fixing member, is protrusive into the inward side of the left plate 41, through the through holes 41*a* and 41*b*, and is fixed to the vertical portion 61*b* of the fixation stay 61 as the fourth metallic plate, and the vertical portion 81*b* of the main stay 81 as the third metallic plate, on the inward side of the left plate 41.

Similarly, the second fixing portion 36*b* of the L-angle 36 as the first fixing member is intrusive into the inward side of the right plate 51, through the through holes 51*a* and 51*b* of the right plate 51 as the second metallic plate. Further, it is fixed to the vertical portion 61*b* of the fixation stay 61, and the vertical portion 81*b* of the main stay 81, on the inward side of the right plate 51. Otherwise, the frame 26 in this embodiment is similar in structure to the frame 26 in the first embodiment.

Even if the frame 26 is structured as described, the deformation of the frame 26 can be prevented by a mechanism which is similar to the mechanism which enables the frame 26 to resist the external forces F1 and F2 (FIGS. 7 and 8) which act on the frame 26.

Embodiment 4

Next, the structure of the image forming apparatus in the fourth embodiment of the present invention is described. The portions of the image forming apparatus, which are the same in description as the counterparts in the first to third embodiments, are given the same referential codes as those given to the counterparts, and are not described here.

Figure 14:
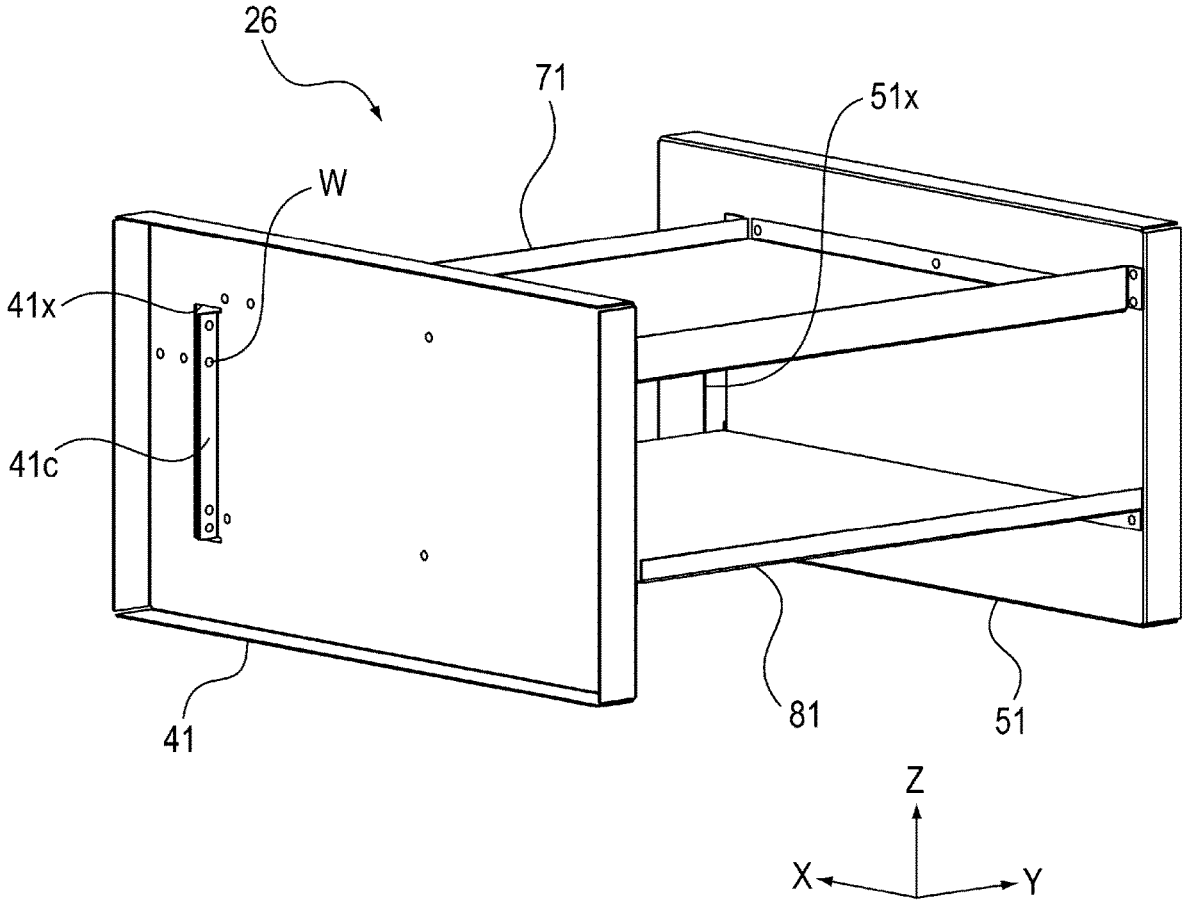
FIG. 14 is a perspective view of the frame.
Figure 15:
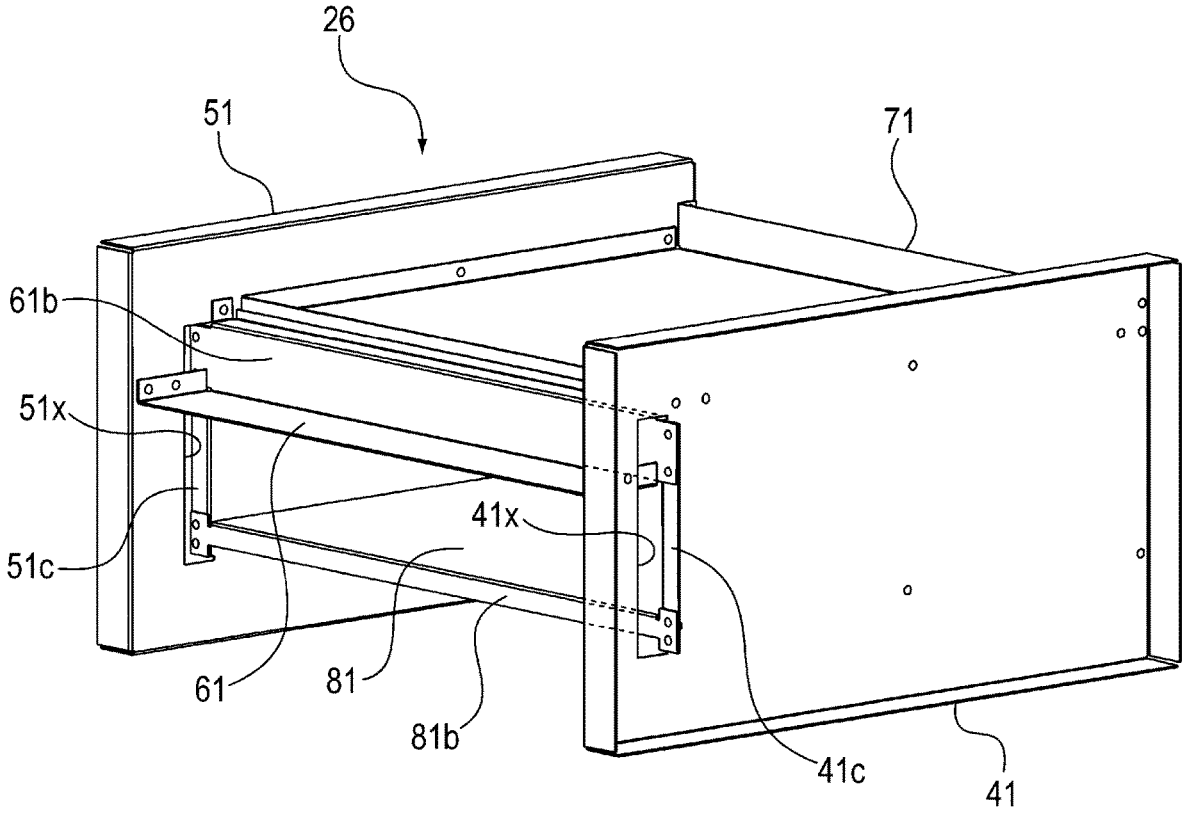
FIG. 15 is s a perspective view of the frame.

FIGS. 14 and 15 are perspective views of the frame 26 of the image forming apparatus in this embodiment, which are different in the angel from which the frame 26 is seen. As shown in FIGS. 14 and 15, the left plate 41 and right plate 51 are not provided with L-angles 31 and 36, respectively. Instead, they are provided with bent portions 41*c* and 51*c*, respectively. Otherwise, the frame 26 in this embodiment is the same in structure as the one in the first embodiment.

The left plate 41 as the first metallic plate, is provided with a through hole 41*x*. The bent portion 41*c* is a part of the left plate 41, which was formed by being bent in the opposite direction from the right plate 51. It is positioned in the adjacencies of the through hole 41*x*.

The right plate 51 as the second metallic plate, is provided with a through hole 51*x*. The bent portion 51*c* is a part of the right plate 51, which was formed by being perpendicularly bent relatively to the main portion of the right plate 51.

The vertical portion 61*b* of the fixation stay 61 as the fourth metallic plate, is positioned in such a manner that it extends outward of the left plate 41 through the through hole 41*x*. It is welded to the bend portion 41*c*.

The vertical portion 61*b* of the fixation stay 61 is positioned in such a manner that it protrudes outward of the right plate 51 through the through hole 51*x*. It is welded to the bent portion 51*c*.

With the frame 26 being structured as described above, as the external forces F1 and F2 (FIGS. 7 and 8) act on the frame 26, a combination of the bent portions 41*c* and 51*c*, and vertical portions 61*b* and 81*b* acts like a rigid one-piece sub-frame, and bears the external forces F1 and F2, which are perpendicular to the thickness direction of these portions made of metallic plate, and resists the external forces F1 and F2. Therefore, the frame 26 is prevented from deforming.

By the way, in each of the first to third embodiments described above, the left plate 41 and right plate 51 were provided with L-angles 31 and 36, respectively. However, as long as one of the left plate 41 and right plate 51 is provided with an L-angle, the frame 26 can be prevented from deforming. Similarly, in the fourth embodiment, the left plate 41 and right plate 51 are provided with the bent portions 41*c* and 51*c*, respectively. However, as long as one of the left plate 41 and right plate 51 is provided with the bent portion, the frame 26 can be prevented from deforming.

INDUSTRIAL APPLICABILITY

According to the present invention, that is provided on an image forming apparatus including a frame constituted by multiple metal plates, in which a frame the formation is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-227620 filed on Dec. 4, 2018, which is hereby incorporated by reference herein in its entirety.

The invention claimed is:

1. An image forming apparatus comprising:

an image forming unit configured to form an image on a recording material;

a first metal plate and a second metal plate provided to sandwich the image forming unit, wherein a through hole is formed in the first metal plate;

a third metal plate provided between the first metal plate and the second metal plate, the third metal plate including a projection; and a fixing member configured to fix the first metal plate and the third metal plate to each other, the fixing member including a first surface and a second surface extending in a direction crossing the first surface, wherein the first surface is fixed on an outer side of the first metal plate, wherein the outer side is opposite to an inner side of the first metal plate where the second metal plate is provided, and wherein one of the projection and the second surface is configured to penetrate the through hole, and the second surface of the fixing member is fixed on the projection, the projection being parallel to the second surface of the fixing member.

2. The image forming apparatus according to claim 1, wherein the projection is configured to protrude from the inner side of the first metal plate to the outer side of the first metal plate through the through hole, and the projection and the second surface of the fixing member are fixed at a position on the outer side.

3. The image forming apparatus according to claim 1, wherein the second surface of the fixing member is configured to protrude from the outer side of the first metal plate to the inner side of the first metal plate through the through hole, and the projection and the second surface of the fixing member are fixed at a position on the inner side.

4. The image forming apparatus according to claim 1, wherein the third metal plate includes a base portion configured to support a member-to-be-supported and a bent portion bent along a surface of the first metal plate, and the bent portion is fixed on the inner side of the first metal plate.

5. The image forming apparatus according to claim 1, wherein the second surface of the fixing member extends in a direction perpendicular to the first surface.

6. The image forming apparatus according to claim 1, further comprising a second fixing member configured to fix the second metal plate and the third metal plate each other, the fixing member including a third surface and a fourth surface extending in a direction crossing the third surface, and wherein a second through hole is formed in the second metal plate, the third metal plate includes a second projection, and one of the second projection and the fourth surface is configured to penetrate the second through hole, and the fourth surface of the second fixing member is fixed on the second projection.

7. The image forming apparatus according to claim 6, further comprising a fifth metal plate different from the third metal plate and the fourth metal plate, the fifth metal plate being provided between the first metal plate and the second metal plate and being fixed to the first metal plate and the second metal plate.

8. The image forming apparatus according to claim 7, wherein the third metal plate supports a fixing apparatus configured to fix a toner image transferred on the recording material onto the recording material.

9. The image forming apparatus according to claim 7, wherein the fourth metal plate supports an intermediary transfer unit including an intermediary transfer belt, and a feeding unit configured to feed the recording material.

10. The image forming apparatus according to claim 7, wherein the fifth metal plate supports an exposing portion configured to expose a photosensitive member with a laser beam.

11. The image forming apparatus according to claim 1, further comprising a fourth metal plate provided between the first metal plate and the second metal plate, the fourth metal plate including a third projection, wherein the second surface of the fixing member is fixed on both the projection and the third projection.

12. The image forming apparatus according to claim 1, wherein the image forming unit includes a photosensitive drum, and projection extends in a rotational axis direction of the photosensitive drum.

13. The image forming apparatus according to claim 1, wherein the first surface of the fixing member is welded to the first metal plate.

* * * * *